US006401863B1

(12) United States Patent
Kirkland

(10) Patent No.: US 6,401,863 B1
(45) Date of Patent: Jun. 11, 2002

(54) MULTI-PURPOSE PORTABLE DAVIT ANCHORING SYSTEM

(75) Inventor: Robert Edward Kirkland, Orlando, FL (US)

(73) Assignee: Best Rescue Systems, Inc., Orlando, FL (US)

( * ) Notice: Subject to any disclaimer, the term of this patent is extended or adjusted under 35 U.S.C. 154(b) by 0 days.

(21) Appl. No.: 09/751,269

(22) Filed: Nov. 28, 2000

Related U.S. Application Data

(60) Provisional application No. 60/173,373, filed on Dec. 28, 1999.

(51) Int. Cl.[7] ..... E04G 1/18

(52) U.S. Cl. ..... 182/142; 182/71; 182/231; 182/236

(58) Field of Search ..... 182/142, 145, 182/150, 5, 231, 236, 71; 414/543

(56) References Cited

U.S. PATENT DOCUMENTS

| | | | | | |
|---|---|---|---|---|---|
| 1,584,117 | A | * | 5/1926 | Mitchell | 182/142 X |
| 3,671,015 | A | * | 6/1972 | Sullivan | 254/142 |
| 3,699,578 | A | * | 10/1972 | Fiorentino | 343/225 |
| 3,804,263 | A | * | 4/1974 | Castonguay | 212/65 |
| 4,096,952 | A | * | 6/1978 | Diggs | 212/56 |
| 4,503,933 | A | | 3/1985 | O'Neil | |
| 4,600,348 | A | * | 7/1986 | Pettit | 414/11 |
| 4,671,384 | A | | 6/1987 | Sing | |
| 4,703,831 | A | * | 11/1987 | Forrest et al. | 182/3 |
| 4,712,645 | A | | 12/1987 | Shih | |
| 5,010,980 | A | | 4/1991 | Thomas | |
| 5,147,013 | A | * | 9/1992 | Olson et al. | 182/231 |
| 5,186,275 | A | | 2/1993 | Bajin | |
| 5,343,981 | A | | 9/1994 | Schroemges | |
| 5,445,487 | A | * | 8/1995 | Koscinski, Jr. | 414/543 |
| 5,586,352 | A | * | 12/1996 | O'Brien et al. | 5/662 |
| 5,738,316 | A | * | 4/1998 | Sweere et al. | 248/123.11 |
| 6,095,080 | A | * | 8/2000 | Weber | 114/370 |
| 6,135,300 | A | * | 10/2000 | Fox | 212/179 |
| 6,155,771 | A | | 12/2000 | Montz | |

* cited by examiner

*Primary Examiner*—Bruce A. Lev
(74) *Attorney, Agent, or Firm*—Elsie C. Turner

(57) ABSTRACT

A new multi-purpose portable davit anchoring system is provided, having a sectional vertical support mast which comes apart for compact stowage and is easily reassembled. The support mast incorporates a screw jack assembly which adjusts the height of the mast and biases the support mast between two opposing surfaces, such as a floor and ceiling. The biasing action enables it to be firmly yet removably attached to a building wherein the exterior walls are not load-bearing but merely sheathing, and to provide support for a damaged ceiling that might otherwise collapse. A boom member is removably fastened to the support mast, for deploying a lifting and lowering cable away from the side of the building. A mounting plate is provided for a winch assembly that can wind up the cable or release it at a controlled rate of speed. Low profile upper and lower brackets for receiving the ends of the support mast are optionally permanently mounted at several locations on each floor of the building with minimal effect on the appearance of the building.

6 Claims, 9 Drawing Sheets

MULTI-PURPOSE PORTABLE DAVIT ANCHORING SYSTEM

This is a formal application based on an earlier-filed provisional application, Ser. No. 60/173,373, filed Dec. 28, 1999.

FIELD OF THE INVENTION

The present invention relates to the general art of securely anchoring loaded rope or cable hanging from upper stories of structures, and to the particular field of portable, quickly deployable support systems for raising and lowering loads in emergency situations.

BACKGROUND OF THE INVENTION

The proliferation of high-rise office and residential buildings in areas of dense population is well-known. These buildings present various problems, among them raising and lowering heavy loads to upper stories, whether in emergency situations such as fire, or during construction or repair of a building. Another problem is the need for anchoring devices for fall prevention equipment during construction or repair. Such anchoring devices are subject to OSHA and ANSI requirements that they be deployed proximate to the point of use, i. e. the worksite, and that they pass a multi-directional pull test.

Many modern buildings do not have load-bearing walls, but rather are supported by a skeleton of steel, and the exterior walls are simply sheathing. In a construction situation, the use of a mobile crane that rises from the ground can be very expensive. Portable roof-mounted booms or derricks have been developed for lifting construction materials to the topmost level of a building under construction. U.S. Pat. No. 6,135,300 discloses a light-weight hoisting apparatus with a boom which can be mounted on a roof parapet wall within minutes. The parapet wall must be steel-reinforced concrete or construction of equivalent strength, thus the device is purposely designed so that it cannot be installed on 8 inch concrete block walls, which are typically not steel reinforced.

Such roof-mounted systems could undoubtedly lower loads as well as raise them, but they do not address emergency needs. Specifically they do not solve the problem of quick deployment of an anchoring system in an emergency situation at upper story balconies and windows lower than the roof, while providing removable attachment to the structure which is of sufficient strength to support the weight of heavy loads, together with reinforcing support of a ceiling in danger of collapsing, when the structure is on fire or otherwise damaged.

There are also numerous devices designed to lower persons from burning high-rise buildings. These inventions for the most part include various cable systems with braking systems for controlling the speed of descent. Only a few of these inventions address the problem of providing a framework for supporting the controlled descent devices, or fall prevention equipment, that is both portable and secure. One of these is an emergency cable descent system disclosed in U.S. Pat No. 5,343,981. This invention includes a boom which can be pivoted outside a window of a building to support a cable away from the exterior wall. This invention does not teach detachability of the boom, any device to limit rotation of the boom when a fixed position of it is desired, or a mode of attachment of the boom to the building which is strong enough to support a heavy load when the exterior wall is not a load-bearing wall. Neither does it appear that this system is adaptable to being deployed from a balcony. Further, it does not teach its application to the task of anchoring fall prevention equipment.

Another relevant invention is disclosed in U.S. Pat. No. 4,671,384. The controlled descent device and cable are suspended from a ladder-like frame which forms a U at its top which straddles a window ledge. There is no boom to hold the load away from the wall of the structure. This system does not appear to be deployable from a balcony that does not have a load-bearing railing, neither are strength of the attachment of the frame to the window ledge, nor detachability, addressed. This device obviously would not pass a multi-directional pull test because it could be dislodged by a pulling force from certain directions.

U. S. Pat. No. 4,503,933 teaches an emergency device stowed in a compact enclosure attached to the lintel of an upper-story window. This addresses the cosmetic problem of unsightliness presented by permanently mounted support frameworks. But this invention has no boom to hold the load away from the walls of the structure.

Accordingly there is a need to provide a multi-purpose portable anchoring device for lifting and lowering equipment for loads to be delivered to or lowered from an upper story of a building, which can be deployed easily and quickly, either on a balcony or in the interior of the building proximate to a window, which adapts to a structure not having load-bearing exterior walls or balcony rails, having a boom which keeps the load away from the exterior side of the building, which can support a winch or reel assembly for a cable, is adjustable to fit varying ceiling heights, and is removable when not in use, so that it does not detract from the appearance of the building. Preferably the device should be adapted to use as an anchoring device for fall-prevention equipment as well.

SUMMARY OF THE INVENTION

The present invention is a multi-purpose portable davit anchoring system comprising a sectional vertical support mast which comes apart for compact stowage and is easily reassembled. The support mast incorporates a screw jack assembly which adjusts the height of the mast and biases the support mast between two opposing surfaces, such as a floor and ceiling. The biasing action enables it to be firmly yet removably attached to a building wherein the exterior walls are not load-bearing but merely sheathing, and to provide support for a damaged ceiling that might otherwise collapse. A boom member is removably fastened to the support mast, for deploying a lifting and lowering cable away from the side of the building. A mounting plate is provided for a winch assembly that can wind up the cable or release it at a controlled rate of speed. Optional low profile upper and lower brackets for receiving the ends of the support mast may be permanently mounted at several locations on each floor of the building with minimal effect on the appearance of the building.

It is thus an object of this invention to provide a new multi-purpose portable davit anchoring system that is easily deployed within a few minutes, that is easily disassembled for stowage when not in use, and that incorporates certain useful features of the prior art, while overcoming some of the disadvantages thereof, which have not been anticipated, rendered obvious, suggested or implied by prior art systems.

It is a further object of this invention to provide a new multi-purpose portable davit anchoring system that provides means of strong attachment to a structure without requiring permanently attached mounting brackets or connections.

Another object of the invention is to provide a new multi-purpose portable davit anchoring system which can be firmly and removably attached to a building which has no load-bearing exterior walls.

It is a further object of this invention to provide a new multi-purpose portable davit anchoring system with a boom that can be temporarily locked in position so that it does not rotate or swing on its mounting pin to an unsafe position too close to the structure where it is deployed.

Still another object of this invention is to provide a multi-purpose portable anchoring system which can support any of a variety of controlled descent winches, (including motorized, remote controlled winches), rope and cable winding devices, rappelling equipment, and other rope- or cable-involved operations for use in emergency environments.

Yet another object of this invention is to provide a multi-purpose portable anchoring system that can be removably deployed from any floor of a high-rise building.

Yet another object of this invention is to provide a multi-purpose portable anchoring system that meets OSHA and ANSI requirements for devices designed to support fall-prevention equipment at high-rise construction sites.

DETAILED DESCRIPTION OF THE PREFERRED EMBODIMENT

Figure 1:
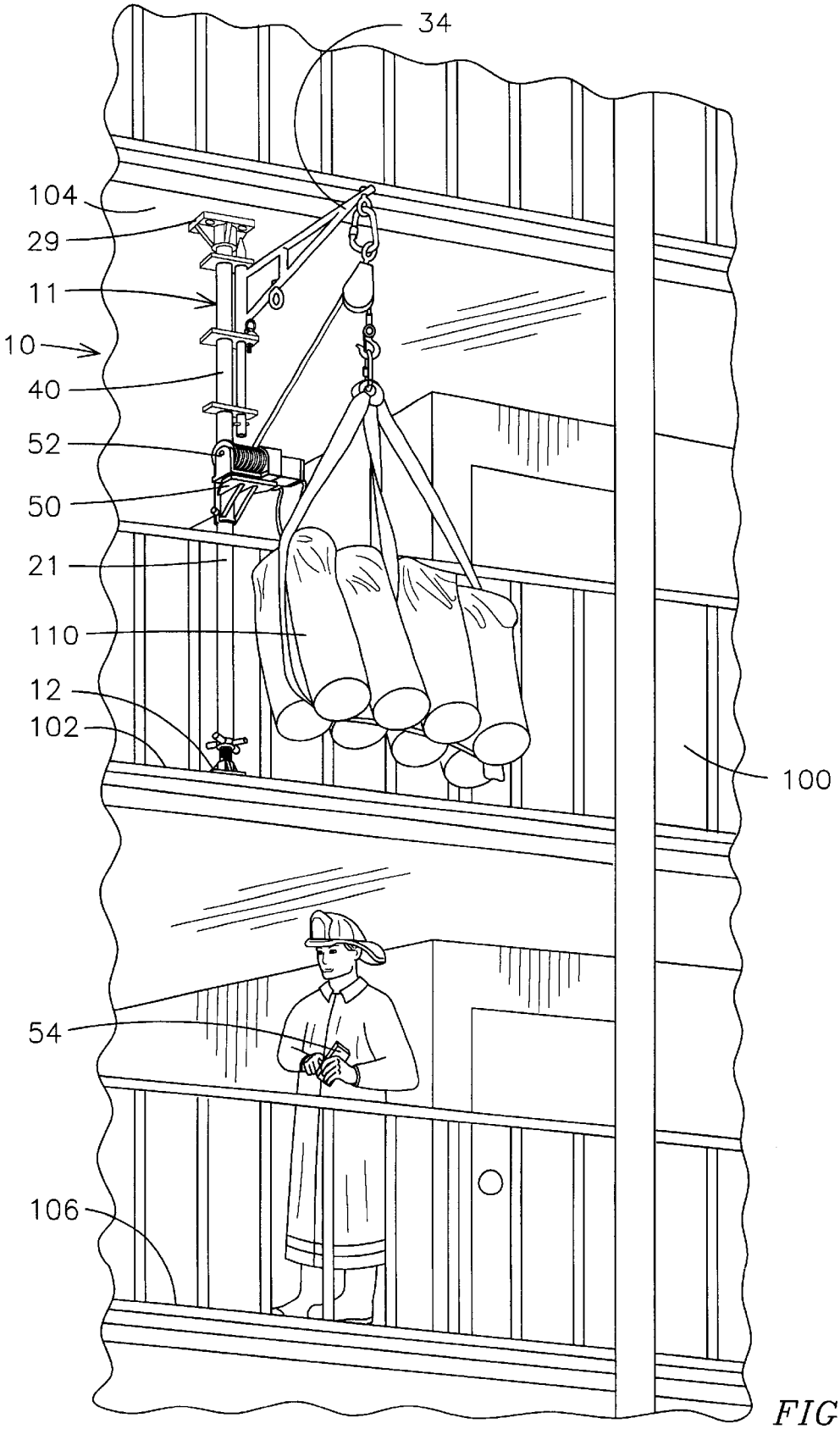
FIG. 1 is a perspective view of the invention installed on a balcony of a building, showing remote radio-controlled operation of its electric winch to support a load of equipment.
Figure 2:
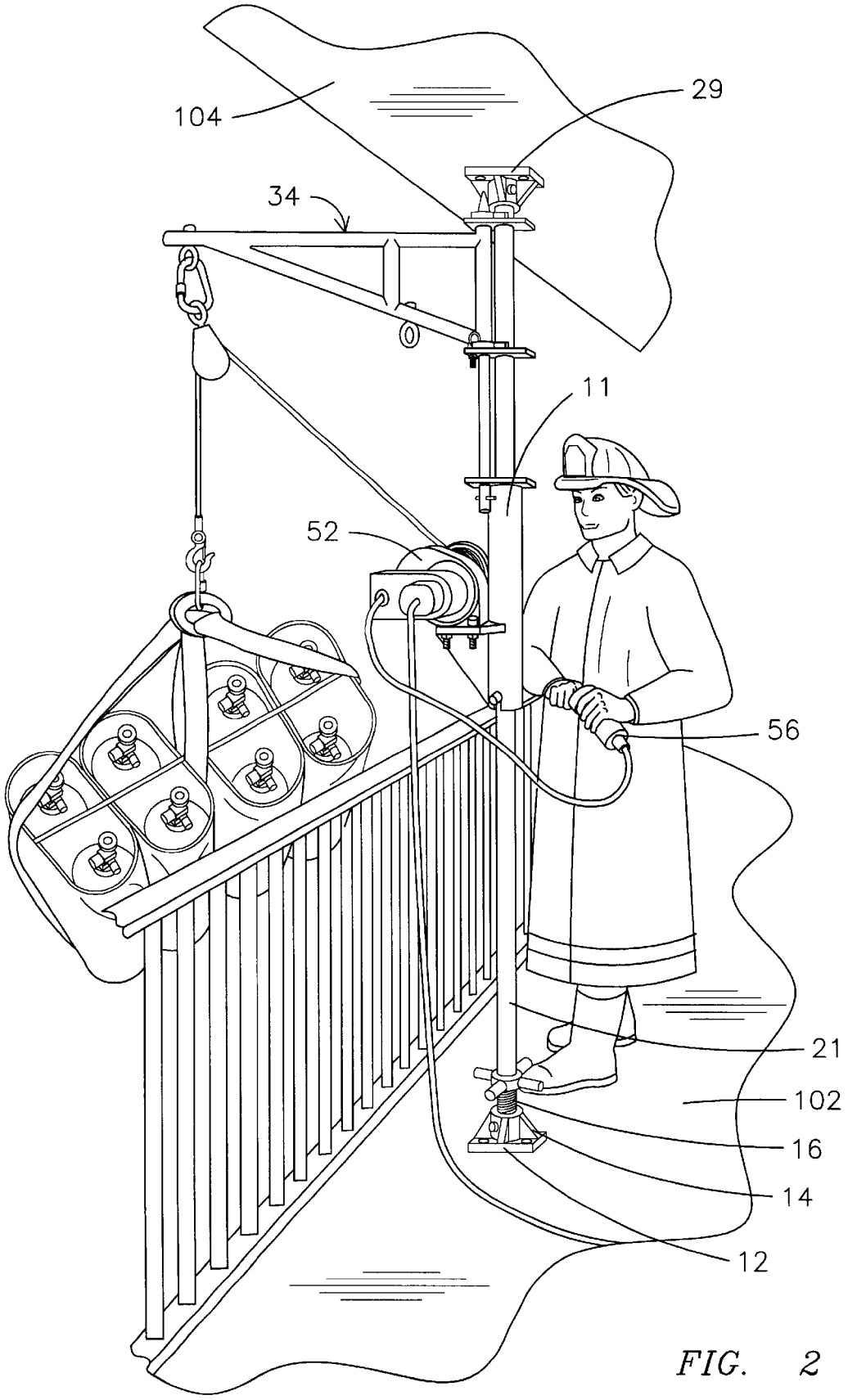
FIG. 2 is similar to FIG. 1, showing manual control of the electric winch.

Referring first to FIG. 1, the portable lift system of this invention 10 is shown secured between an exterior balcony floor 102 and ceiling 104 of a high-rise building 100. In this view a bracket 50 mounted on davit assembly 11 supports an electric motorized winch member 52, shown hoisting a load 110. The operation of the winch 52 can be remotely controlled by radio 54 from a lower floor balcony 106 of the building. FIG. 2 shows the motorized winch member 52 being operated by a manually-operated switching member 56. The Cordem Corporation manufactures a line of lightweight and compact power winches under the federally registered trademark GOLO® which are suitable for use as the motorized winch member 52, but other suitable power winches are available on the market. An optional anchoring or security line 112 attached to the building at one end and secured to the davit assembly, shown in FIG. 9, can serve to offset the leverage of the load 110 on the upper end of davit assembly 11.

Figure 3:
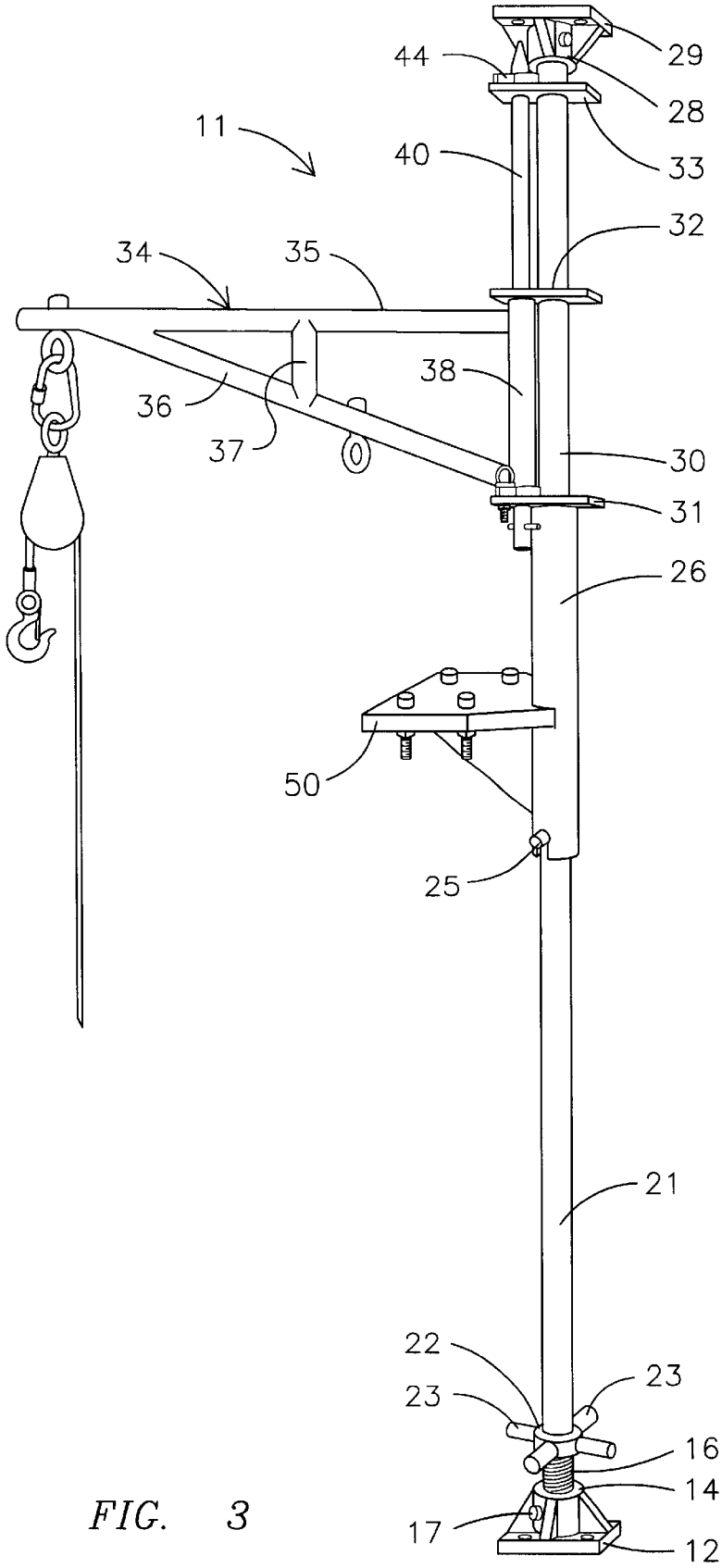
FIG. 3 is a side perspective view of the davit assembly of the invention.
Figure 4:
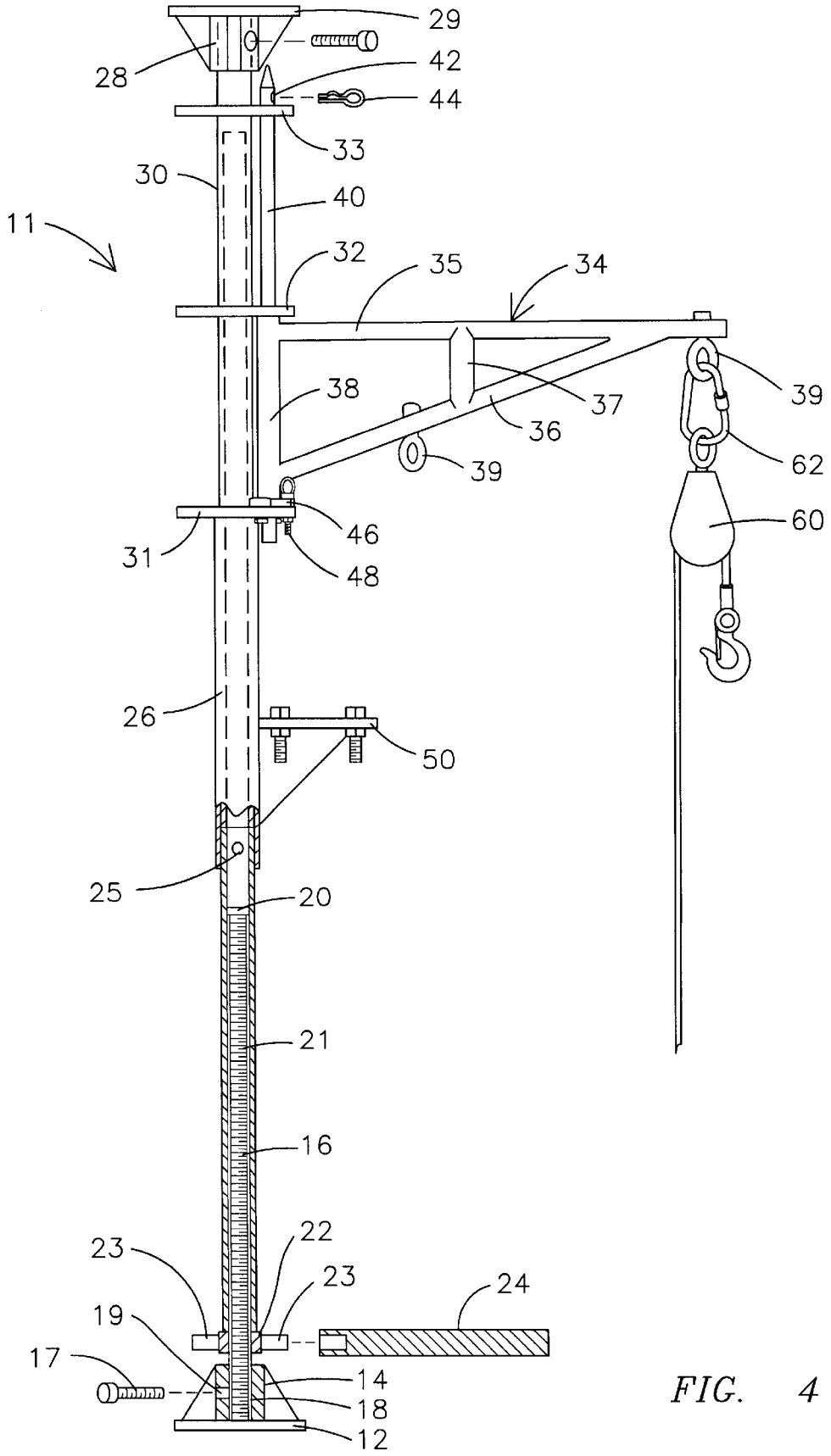
FIG. 4 is a side elevational view of the davit assembly with a vertical section of its mast sections.
Figure 5:
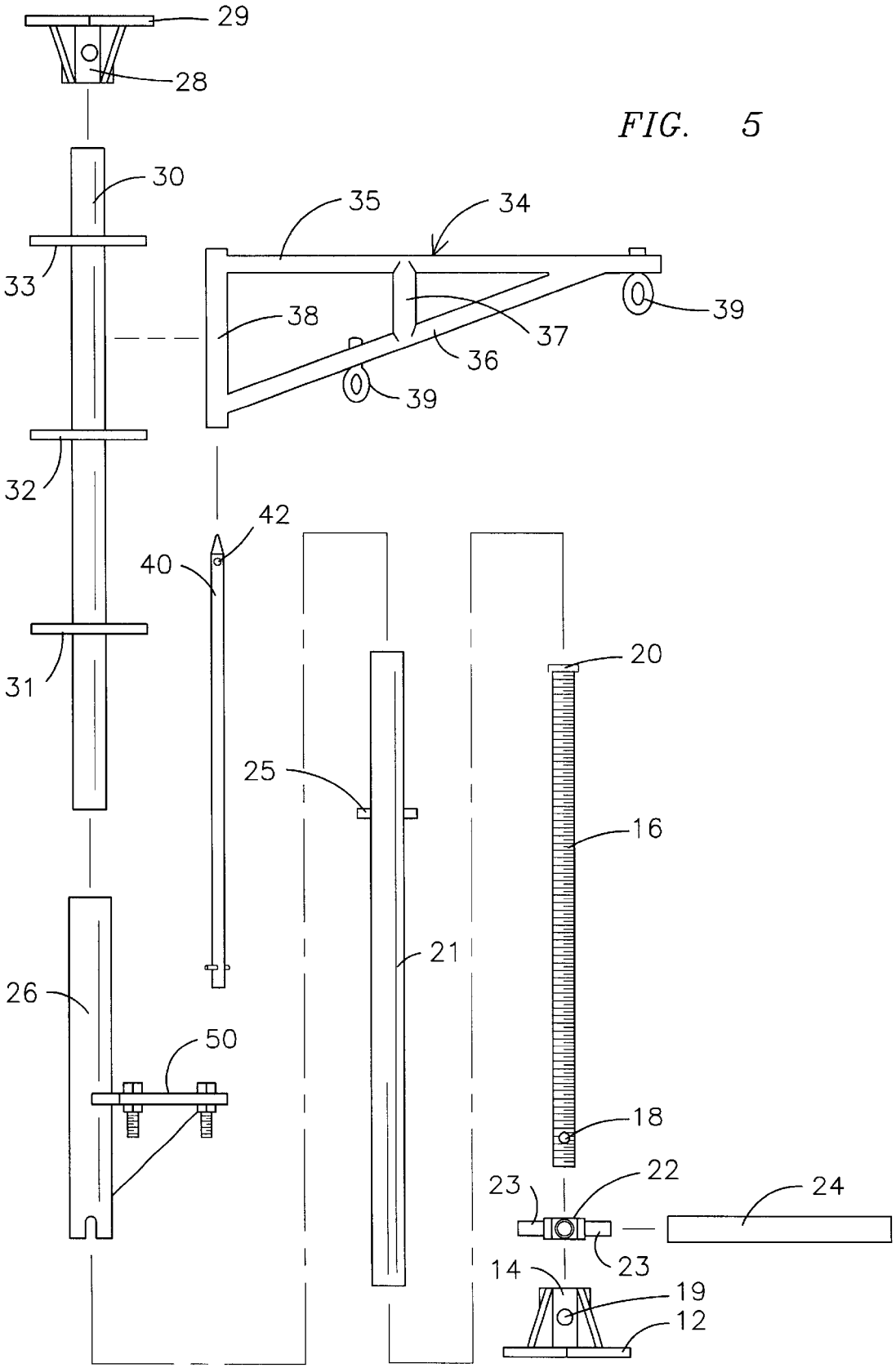
FIG. 5 is an exploded view of the components of the davit assembly.

Referring to FIGS. 3, 4 and 5, it can be seen that davit assembly 11 is removably secured to a floor by a base mounting member 12 and to a ceiling or other overhead horizontal surface by an upper mounting member 29. Base mounting member 12 has an integral socket 14 projecting vertically from the mounting member for receiving the lower end of screw jack member 16, optimally solid steel 1.5" in diameter. Screw jack 16 is secured in place in socket 14 by lower mount bolt 17 inserted through aligned and matching holes, 18 into the screw jack, and 19 through socket 14. Screw jack 16 inserts at its upper end into a lower mast member 21, a hollow cylinder. Lower mast member 21 rides up and down the screw jack on torque nut 22 with gripping lugs 23, nut 22 being threaded to mate with the threads of the screw jack. A handle 24 provides leverage for easy, rapid tightening, and fits any lug 23 on the torque nut 22. Screw jack member 16 removably inserts into the lower end of mast coupling member 26, a cylindrical sleeve, which is supported on a pin 25 affixed near the upper end of lower mast member 21. An upper mast member 30, removably inserts at its lower end into the upper end of coupling member 26. The upper end of mast member 30 removably inserts into socket 28, integral with upper mounting member 29. Upper mast member 30 inserts through two or more attached boom support brackets 31, 32, and 33, which will be more fully described below. The lowest of these brackets 31 acts as a stop to support upper mast member 30 on the top of coupling member 26. Thus when torque nut 22 is turned in a direction to travel upward on screw jack 16, lower mast member 21 rides upward, thereby causing coupling member 26 and upper mast member 30 to rise correspondingly. When torque nut 22 reaches its maximum height on screw jack 16, limited by stop 20, davit assembly 11 is locked in place by virtue of being biased against the floor at its lower end and against the ceiling or overhead surface at its upper end.

Boom support brackets 31, 32 and 33 affixed to upper mast member 30 are designed to support one or two detachable boom members 34 on davit assembly 11. They have matching, aligned orifices 31*o*, 32*o*, and 33*o* therethrough to receive boom alignment pin 40. Optimally pin 40 is made of solid steel at least ¾" in diameter.

FIG. 5 shows boom member 34 comprised of horizontal arm 35, cross brace 36, and verticalt struts 37 and 38. Strut 38, connecting the proximal ends of arm 35 and cross brace 36, is tubular and has a diameter sufficiently greater than that of orifices 31*o*, 32*o*, and 33*o* so that strut 38, when aligned between either brackets 31 and 32, or 32 and 33, at the aligned orifices therethrough, and when boom alignment pin 40 is inserted through said orifices and through strut 38, boom member 34 is secured to said brackets. A hole 42 through the upper tip of boom alignment pin 40 receives a hairpin clip 44 to keep it from falling out of place. A small roll pin 46 protruding horizontally near the lower end of strut 38 acts in cooperation with a small index pin t 48 inserted vertically through one of several corresponding small holes 49 in the lower of the two brackets supporting boom member 34 to lock it at any one of several pre-selected angles. The design of upper mast member 30, the location of its brackets 31, 32 and 33 thereon, and the boom alignment pin is such that upper mast member 30 can be inverted, thereby changing the levels on davit assembly 11 at which boom member 34 is attached.

In FIG. 5, boom member 34 is shown equipped with two eyebolts 39 which are preferably sized to accept various sizes of carabiners 62 and made of forged steel rated for several tons. Block and tackle 60 of appropriate strength for raising or lowering loads can be attached to said eyebolts. Block and tackle 60 should incorporate a self-locking pulley.

Eyebolts 39 can also be used, as in FIG. 1, to suspend an anchor line from a boom member 34, either to counter the tendency of the upper mounting plate 30 to slip sideways in the direction of the suspended load, or to control movement of the boom member when it is desired to move it from an outboard position to an inboard position relative to a balcony.

Figure 6:
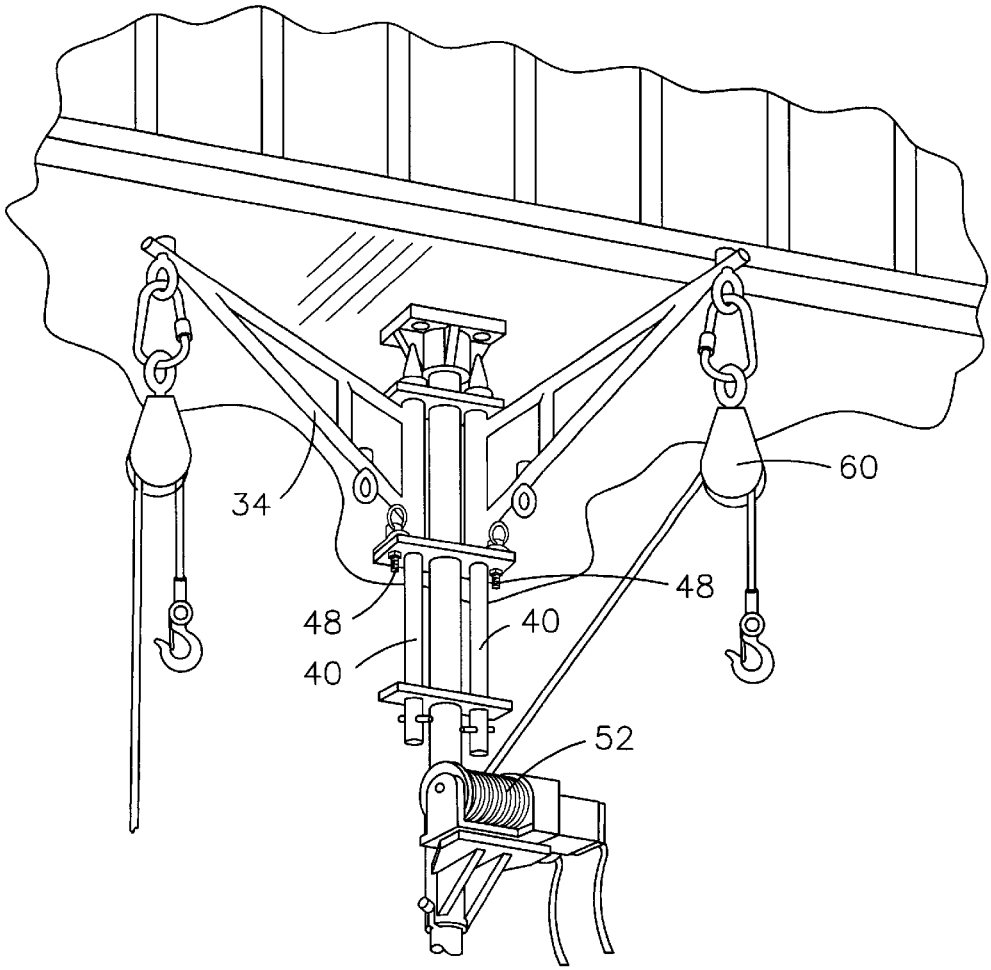
FIG. 6 is a partial perspective view of a two-boom embodiment of the davit assembly.

FIG. 6 illustrates the adaptability of davit assembly 11, in that two boom members 34 may be supported between the same pair of boom support brackets, either 31 and 32, or 32 and 33. It can be seen that each such boom support bracket has two boom alignment pin holes, i.e., two each of 31*o*, 32*o*, and 33*o*, disposed in line with and on either side of upper mast member 30. In FIG. 6, boom members 34 are shown projecting outward from a building at different angles, but they can be set parallel to one another as well.

Figure 7:
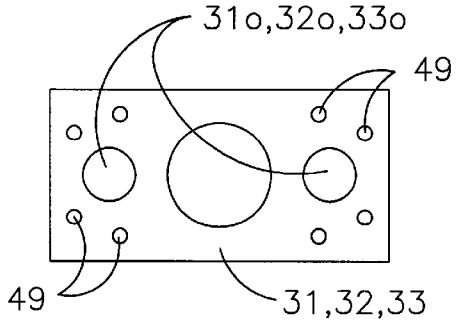
FIG. 7 is a top plan view of a boom support bracket.

FIG. 7, a top plan view of a boom support bracket, 31, 32, or 33, shows the arrangement of various holes: 31*o*, 32*o*, or 33*o*, for boom alignment pin 40; and 49 for the insertion of an index pin 48.

Figure 8:
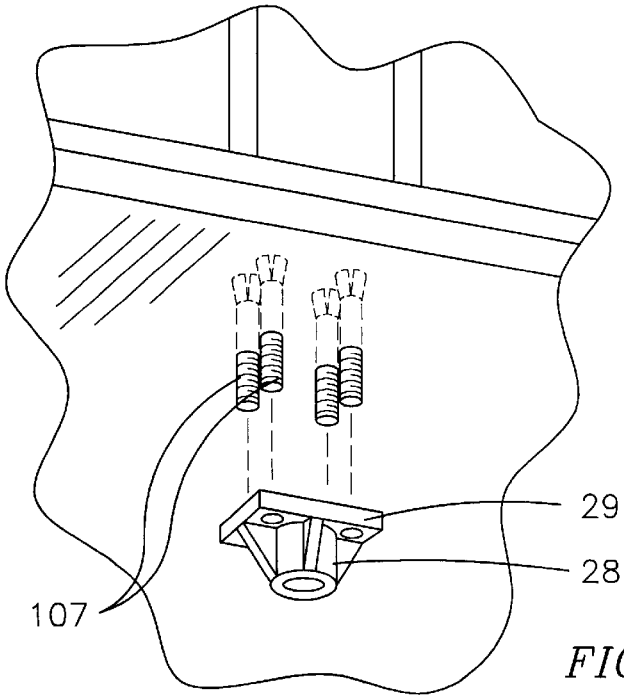
FIG. 8 is a partial exploded view of optional bolting of a mounting plate.
Figure 9:
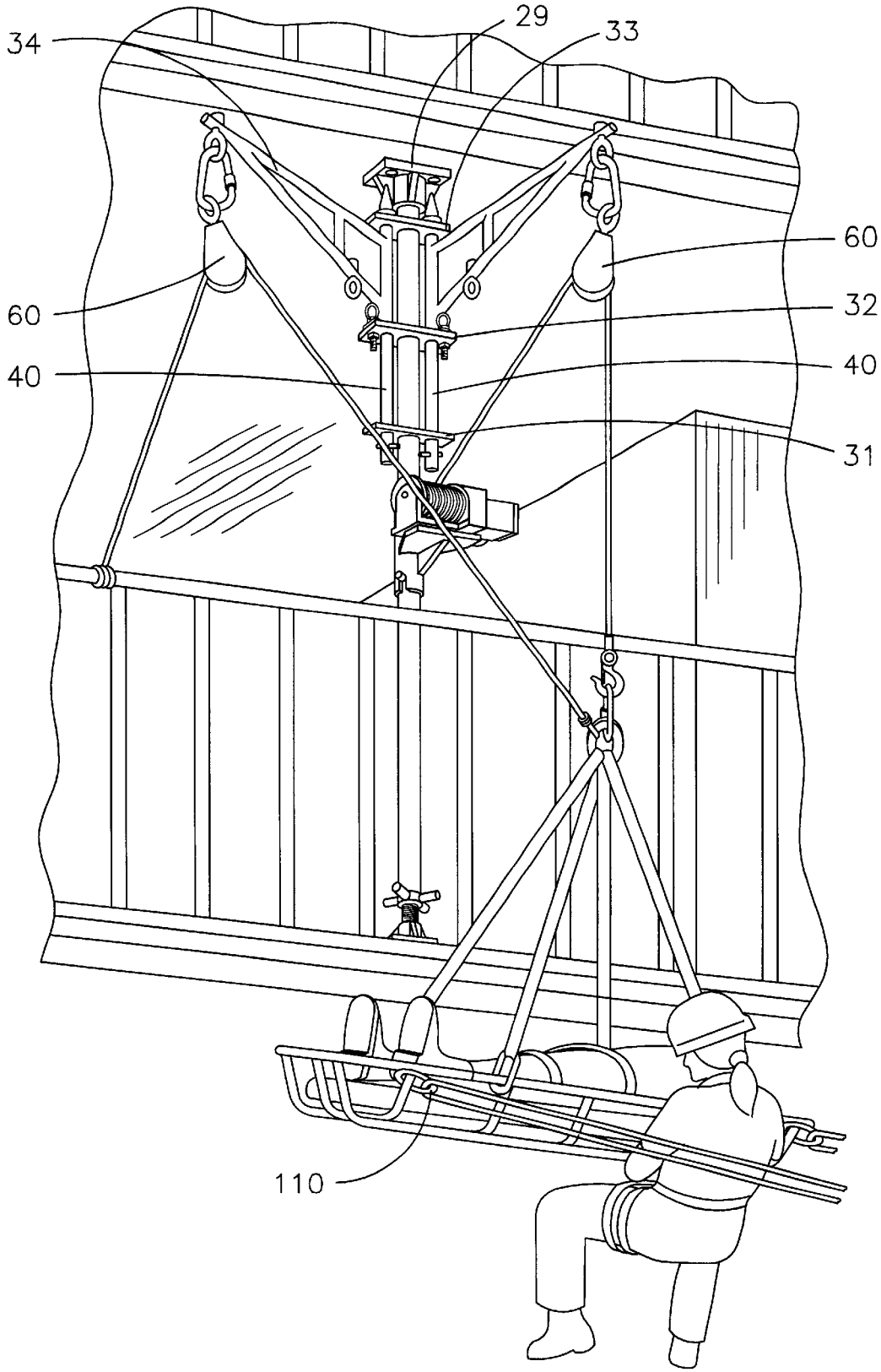
FIG. 9 is a perspective view of the embodiment of FIG. 6 effecting rescue of a person.

FIG. 8 depicts optional securing of upper mounting plate member 29 to a balcony ceiling with bolts 107 for added resistance to the leverage exerted by a heavy load suspended at the outboard end of boom member 34. However the invention is capable of supporting a load of up to 400 pounds without bolting its mounting plates 12 and 29 in place, the biasing action provided by the telescoping davit assembly and screwjack being sufficient. FIG. 9 illustrates the invention 10 being used as a rescue device for lowering an injured person from a high rise disaster situation. A second boom member 34 is being used to suspend block and tackle to divide the load as well as to reduce swinging of the load on the line from the winch 52. As shown in FIGS. 1, 2, and 9, boom member 34 has a horizontal length that allows a load suspended therefrom to be raised or lowered without contact with the structure on which the invention is installed.

Figure 10:
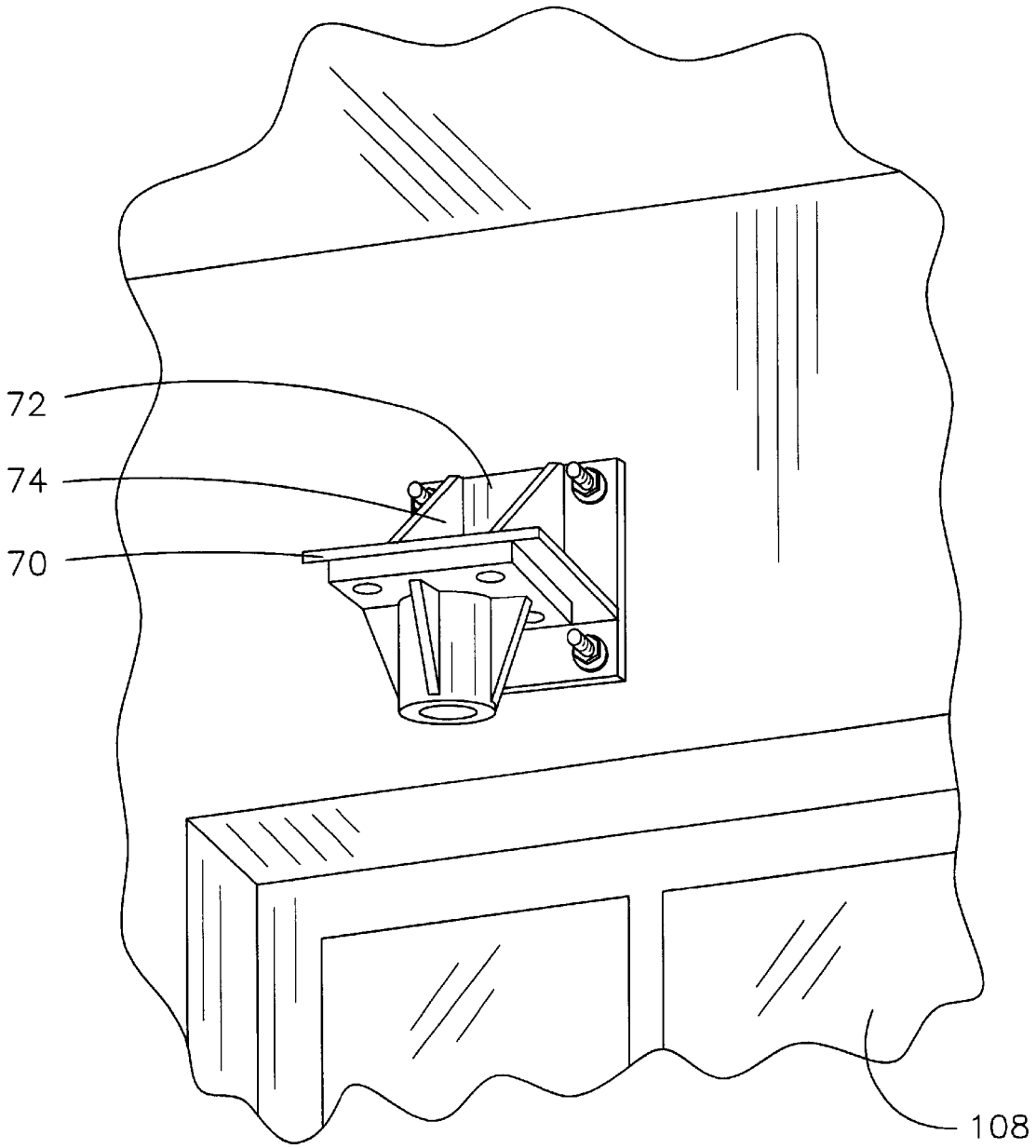
FIG. 10 is a perspective view of an alternative upper mounting bracket for use on a vertical wall.
Figure 11:
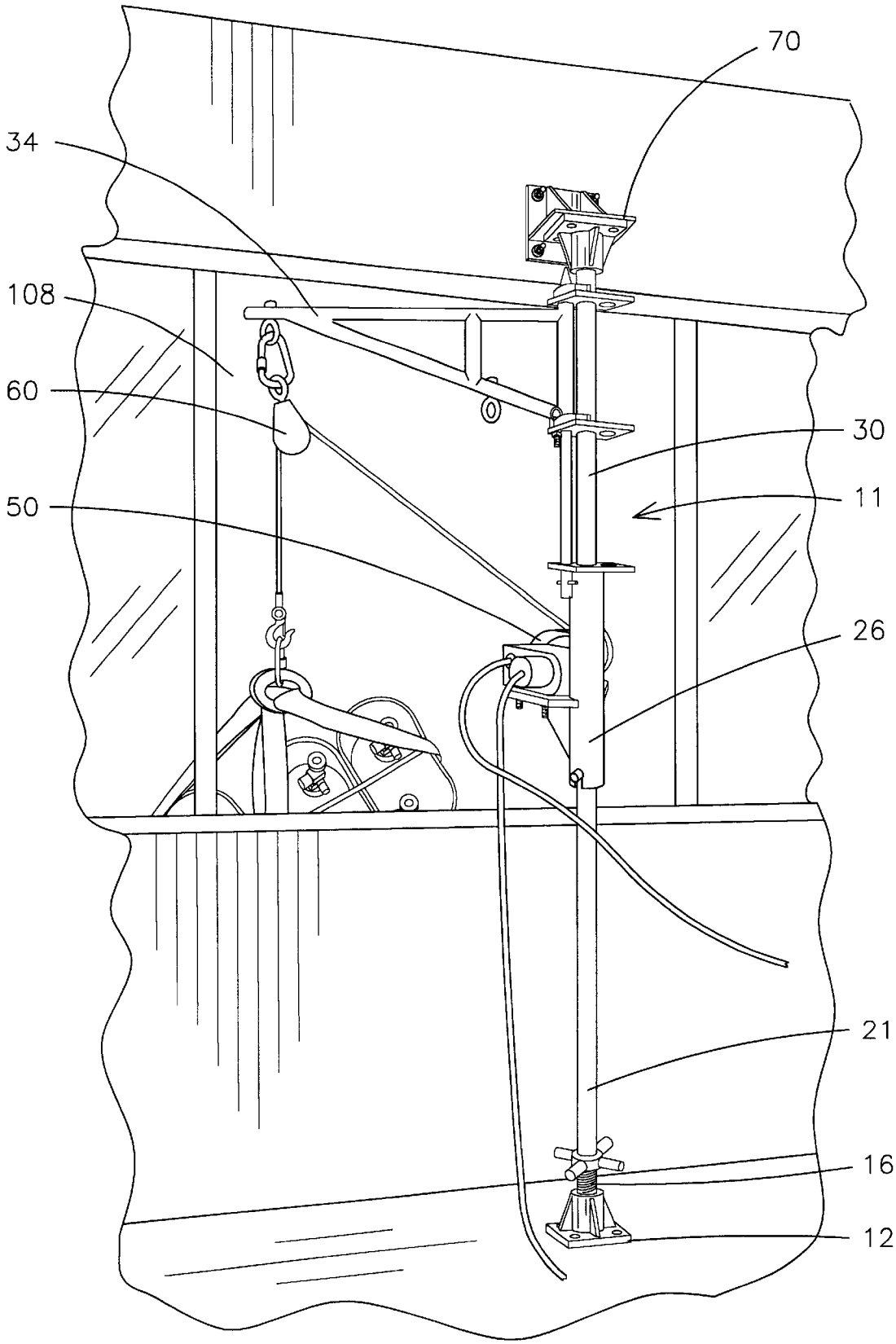
FIG. 11 is a perspective view of the invention installed on the inner surface of a building window wall using the alternative upper mounting bracket of FIG. 10.

In the case of a building having no balconies, a slightly different mounting system is depicted in FIGS. 10 and 11. The invention is installed just inside an open or broken-out window 108 using the same base mounting plate member 12, but a different upper mounting member 70 having an integral vertical flange 72 and struts 74 which is bolted to the wall above a suitable window. A number of the mounting brackets 12 and 29, or 12 and 70 can be more or less permanently affixed outside windows in strategic locations, of a building and the other components stored in inside utility closets so that the esthetic appearance of the building is not diminished when use of the invention is not needed.

The invention as shown in FIGS. 1 through 11 can be taken apart, or assembled and jacked into a tight fit between floor and ceiling, within two or three minutes. The preferred embodiment of the invention is formed of 4130 chrome molybdenum steel alloy, stainless steel, or titanium and is relatively lightweight. It is ideally suited for supporting a controlled descent device for rescue of persons in danger in high-rise buildings and the like, when conventional stairways or elevators are inaccessible. Together with the motorized hoist 52, it can be used to lift or lower fire-fighting tools and equipment to a height of thirty stories in a matter of minutes. Other applications include use as an alternative elevator or economical substitute for a crane in the construction of high rise buildings, and for moving large pieces of furniture or equipment into suites or apartments where conventional access and elevators are overburdened or otherwise inadequate. In field applications where electric power is not available, the system could be operated with a portable generator. The invention meets ANSI and OSHA standards for anchoring fall-prevention equipment at high rise construction sites where the workers wear harnesses attached to anchored safety lines. Such anchoring devices must be proximate to the worksite and must withstand a multidirectional pull test. The mast assembly with its screw jack can withstand pulling forces from any direction up to 400 pounds without being bolted to the structure where it is deployed.

It will be appreciated that numerous adaptations and modifications can be made to the embodiments disclosed herein without departing from the spirit and scope of the invention. For instance the invention could be deployed horizontally, between two walls, and the cable attached to load to be hauled up an incline, or in a generally horizontal direction, as well as vertically. As such, those skilled in the art will recognize that the conception on which this invention is based can be utilized to design other devices and systems for related tasks. It is important, therefore, that the claims be viewed as including equivalent constructions that do not depart from the spirit and scope of the present invention.

What is claimed is:

1. A multi-purpose portable davit anchoring system for use in a high-rise structure, comprising:

a support mast assembly of adjustable length and having a circumference, said mast assembly comprised of a plurality of detachable sections including a screw jack member for adjusting the height of said mast assembly, adapted for removably mounting on, and biasing said mast assembly at each end thereof against, opposing structural surfaces;

a pair of mounting brackets adapted to be affixed to said opposing structural surfaces in opposing alignment, for removably receiving the ends of said mast assembly;

at least one boom member removably attached to said mast assembly, at any one of a predetermined plurality of positions disposed around the circumference of said mast assembly, said boom member having a proximal and a distal end and comprising a horizontal arm, a tubular vertical strut at its proximal end, and a cross brace connecting said vertical strut to said distal end, and having at least one turning block attached to said distal end;

a pair of boom support brackets affixed to said mast assembly for supporting a boom member therebetween, said support brackets having at least one pair of vertically aligned first orifices therethrough;

a mounting pin for removably fastening said boom member to said support brackets by alignment of said vertical strut between said first orifices and insertion of said mounting pin through said vertical strut and said first orifices;

locking means for preventing the vertical strut from rotating on the mounting pin, comprising a plurality of second orifices, smaller in diameter than the first orifices, disposed about one of each pair of vertically aligned first orifices, together with locking pins removably inserted in said second orifices, whereby said boom member is fixed at one of a plurality of predetermined positions about the circumference of said mast assembly;

reeling means, including a winch, mounted on said mast assembly, adapted for raising and lowering a load;

a cable passing through said turning block and around said winch, said cable having attachment means at one end thereof for attaching a load; and braking means for controlling speed and extent of descent of a load being lowered by said reeling means and cable.

2. The system according to claim 1 wherein said reeling means is a power winch and said braking means is incorporated within said power winch.

3. The system according to claim 1 wherein said mounting brackets are adapted for mounting said mast assembly between the floor and ceiling of an upper story balcony of a structure.

4. The system according to claim 1 wherein said mounting brackets are adapted for mounting said mast assembly inside an upper story room of a structure, adjacent a window, said mounting brackets comprising a floor bracket and a wall bracket.

5. The system according to claim 2 wherein said power winch has remote-control capability.

6. A multi-purpose portable davit anchoring system for deployment from an upper story of a high-rise edifice, comprising:

a support mast assembly of adjustable length and having a circumference, said mast assembly comprised of a plurality of detachable sections including a screw jack member for adjusting the height of said mast assembly and adapted for removably mounting on, and biasing said mast assembly at each end thereof against, a floor and a ceiling, or other structural surface of, a high-rise edifice;

a pair of mounting brackets adapted to be affixed to said floor, and to said ceiling or other structural surface, in vertical opposing alignment, for removably receiving the ends of said mast assembly;

at least one boom member, removably attached to said mast assembly, having a distal end and a proximal end, said boom member comprising a horizontal arm, a tubular vertical strut at its proximal end, a cross brace connecting said vertical strut to said distal end of said boom member, and at least one turning block pivotably attached to said distal end;

a pair of boom support brackets affixed to said mast assembly in vertical alignment, for supporting one or more boom members therebetween, each said boom support bracket having a first orifice therethrough vertically aligned with the first orifice of the other bracket of the pair, and one said bracket having a plurality of second orifices disposed about said first orifices;

a mounting pin for removably fastening one said boom member to said support brackets by alignment of said vertical strut between said first orifices and insertion of said mounting pin through said vertical strut and said first orifices;

locking pins removably inserted in said second orifices for preventing said vertical strut from rotating on its mounting pin, whereby the boom member may be locked at one of a plurality of predetermined positions about the circumference of said mast assembly;

a motorized, remote-controllable winch for reeling or unreeling cable, said winch removably supported on said mast assembly and incorporating braking means for controlling the rate of speed and extent of unreeling of a cable wound therearound;

a cable passing through said turning block and around said winch, said cable having attachment means at one end thereof for attaching a load.

* * * * *